United States Patent [19]

Gumbs, deceased

[11] 3,991,430

[45] Nov. 16, 1976

[54] SHOE LAST

[75] Inventor: Alexis A. Gumbs, deceased, late of Staten Island, N.Y., by Uranie L. Gumbs, administratrix

[73] Assignee: The Raymond Lee Organization, Inc., New York, N.Y. ; a part interest

[22] Filed: Aug. 18, 1975

[21] Appl. No.: 605,379

[52] U.S. Cl. ..... 12/115.2; 12/142 R
[51] Int. Cl.[2] ..... A43D 5/00; A43D 9/00
[58] Field of Search ..... 12/115.2, 115.4, 142 R

[56] References Cited

UNITED STATES PATENTS

| | | | |
|---|---|---|---|
| 1,482,584 | 2/1924 | Scheritz | 12/115.2 |
| 1,621,617 | 3/1927 | Young | 12/115.2 |
| 2,070,234 | 2/1937 | Loeffler | 12/115.2 |

*Primary Examiner*—Patrick D. Lawson
*Attorney, Agent, or Firm*—Howard I. Podell

[57] ABSTRACT

A shoe last fitted with five toe projections of adjustable length for forming the interior of a shoe to fit comfortably about the wearer's toes. The last and attached shoe is attachable to a vibrator unit for deforming the interior of the attached shoe, to fit about the toe projections.

3 Claims, 2 Drawing Figures

FIG. 1
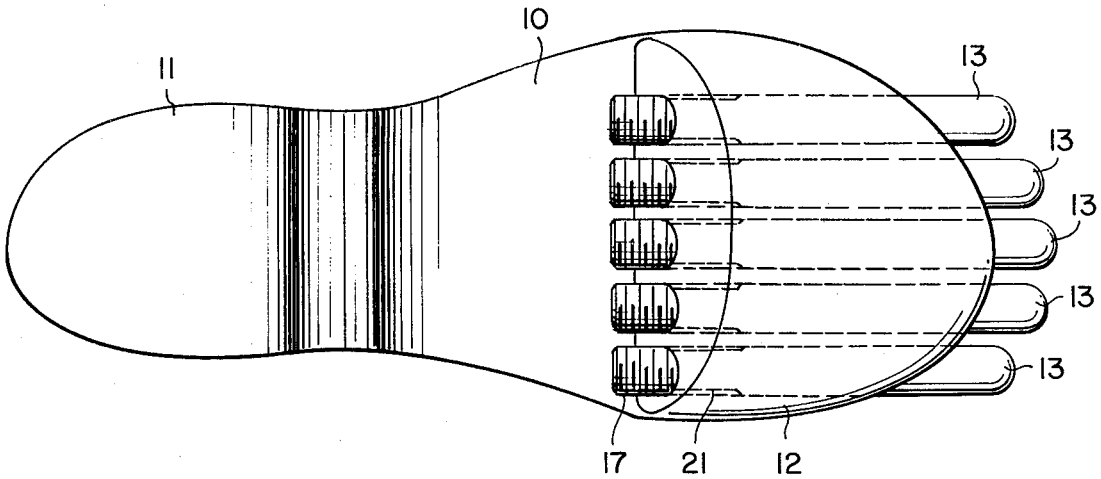
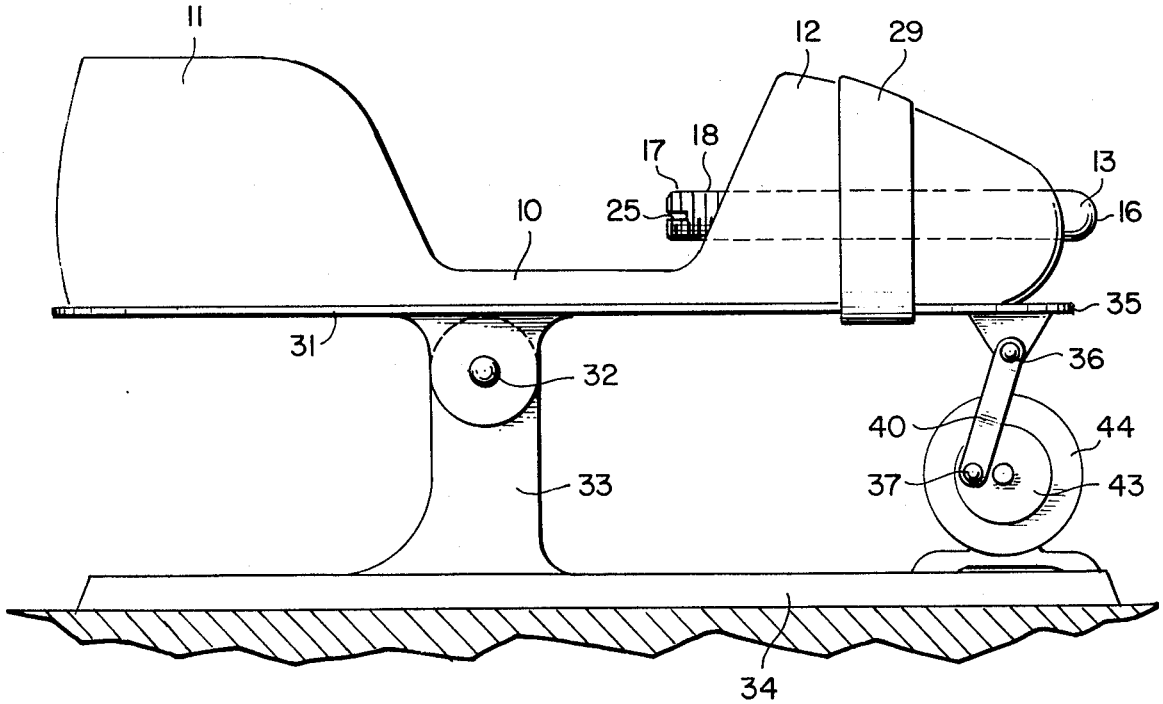
FIG. 2

SHOE LAST

SUMMARY OF THE INVENTION

My invention is a shoe last fitted with five toe projections of adjustable length for forming the interior of a shoe to fit comfortably about the wearer's toes. The last and attached shoe is attachable to a vibrator unit for deforming the interior of the attached shoe, to fit about the toe projections.

Each toe projection is fitted to a male screw thread that is engaged by a female thread of the toe section of the last so that the length of each toe projection may be varied at will.

The vibrator unit consists of a platform mounted on a fixed base, with a lever from the platform joined to an off-center location on a rotatable wheel fastened to the base, such that rotation of the wheel causes the platform to vibrate. The wheel may be manually operated or fastened to an electric motor.

BRIEF DESCRIPTION OF THE DRAWINGS

The objects and features of the invention may be understood with reference to the following detailed description of an illustrative embodiment of the invention, taken together with the accompanying drawings in which:

FIG. 1 is a plan view of the shoe last; and

FIG. 2 is a side view of the shoe last mounted on the vibrator.

DESCRIPTION OF THE PREFERRED EMBODIMENT

Turning now descriptively to the drawings, in which similar reference characters denote similar elements throughout the several views, FIGS. 1–2 illustrate the shoe last 10 which is formed of a heel section 11 joined to a toe section 12, of a size to fit into a shoe (not shown). Five toe members 13 project from the forward section of the toe section 12, with each toe member of a cylindrical shape and formed with a hemi-spherical free end 16. Each toe member is formed at its inner end 17 with a male thread form 18 that engages a female thread form 21 in the toe section so that rotation of the toe member 13 serves to vary the extent that the end 16 projects beyond the toe section 12. The inner end 17 of each toe member 13 is formed with a slot 25 for engaging a screw driver.

The heel section 11 may be joined to the toe section 12 by conventional adjustable means to regulate the separation of the heel section 11 from the toe section 12.

A shoe (not shown) may be placed about the shoe last 10, with the toe member 13 suitably adjusted to match the lengths of the toes of the wearer of the shoe for stretching the interior of the shoe.

The last 10 and attached shoe may be mounted by strap 29 on a platform 31 fitted by a pivot 32 to a vertical support 33. Support 33 is fixed to a horizontal base 34, with the toe end 35 of the platform 31 attached by a pivot 36 to a vibrating support means 40 for vibrating the platform 31 to deform the shoe interior about the last toe members 13.

Vibrating support means 4o comprises a link member 40 joined to pivot 36 of the platform 31 and joined by pivot 37 to an off-center location on wheel 43 rotatably mounted to base 34. Alternately, wheel 43 may be powered by a motor 44 fixed to the base 34. Rotation of wheel 43 serves to vibrate platform 31 and attached shoe and shoe last 10.

Since obvious changes may be made in the specific embodiment of the invention described herein, such modifications being within the spirit and scope of the invention claimed, it is indicated that all matter contained herein is intended as illustrative and not as limiting in scope.

Having thus described the invention, what I claim as new and desire to secure by Letters Patent of the United States is:

1. A shoe last for selectively deforming the interior of a shoe to fit comfortably about the toes of a wearer of the shoe, comprising a shoe last formed of a heel section and a toe section, said toe section fitted with a plurality of individual projecting members that extend beyond the forward portion of the toe section in the axial direction of the shoe last, with the length that each projecting member extends beyond the toe section being individually adjustable, in which each projecting member is formed with a male thread that engages an individual female thread formed in the toe section so that rotation of the projecting member varies the extent of projection beyond the toe section.

2. The combination as recited in claim 1 together with a vibration machine fitted with means to fasten to the shoe last and to a shoe in which the said shoe last is mounted, said vibration machine serving to apply vibrating force to the fastened shoe last and shoe so as to permanently deform the interior of the shoe.

3. A method of permanently deforming the interior of a shoe comprising the following steps:

a. Mounting an expansible shoe last inside a shoe;

b. Expanding the said shoe last inside the shoe;

c. Mounting the shoe fitted with the shoe last on a vibration machine;

d. Actuating the vibration machine to vibrate said shoe and shoe last.

* * * * *